US006055721A

United States Patent [19]

Mamada et al.

[11] Patent Number: 6,055,721

[45] Date of Patent: May 2, 2000

[54] METHOD OF MANUFACTURING A CHIP INDUCTOR

[75] Inventors: Nobuo Mamada; Masataka Kohara, both of Tokyo, Japan

[73] Assignee: Taiyo Yuden Kabushiki Kaishi, Tokyo, Japan

[21] Appl. No.: 09/231,486

[22] Filed: Jan. 14, 1999

Related U.S. Application Data

[62] Division of application No. 08/917,339, Aug. 25, 1997, which is a continuation of application No. 08/613,626, Mar. 11, 1996, abandoned.

[30] Foreign Application Priority Data

Apr. 28, 1995 [JP] Japan ..... 7-105927

[51] Int. Cl.[7] ..... H01F 7/06

[52] U.S. Cl. ..... 29/605; 29/608; 336/83; 336/192; 336/212

[58] Field of Search ..... 29/605, 608; 336/83, 336/192, 212

[56] References Cited

U.S. PATENT DOCUMENTS

| | | |
|---|---|---|
| 4,696,100 | 9/1987 | Yamamoto . |
| 4,842,352 | 6/1989 | Sasaki et al. . |

FOREIGN PATENT DOCUMENTS

| | | | |
|---|---|---|---|
| 58-48410 | 3/1983 | Japan . | |
| 0151407 | 8/1984 | Japan | 336/192 |
| 6-5427 | 1/1994 | Japan . | |
| 7-74024 | 3/1995 | Japan . | |

*Primary Examiner*—Carl E. Hall
*Attorney, Agent, or Firm*—Armstrong, Westerman, Hattori, McLeland & Naughton

[57] ABSTRACT

A chip inductor has a magnetic member which is formed by sintering and a coiled conducting wire which is embedded in the magnetic member. The magnetic member has a clearance in each axial end portion thereof such that each terminal end portion of the coiled conducting wire is exposed to an outside of the magnetic member in a linear configuration. An external electrode is formed on each end portion of the magnetic member such that the external electrode penetrates into the clearance into contact with the terminal end portions of the coiled conducting wire.

15 Claims, 2 Drawing Sheets

METHOD OF MANUFACTURING A CHIP INDUCTOR

This application is a divisional application of U.S. patent application Ser. No. 08/917,339 filed on Aug. 25, 1997, which is a continuation application of U.S. patent application Ser. No. 08/613,626, filed on Mar. 11, 1996, now abandoned.

BACKGROUND OF THE INVENTION

1. Field of the Invention

The present invention relates to a chip inductor which is small in size and has a high impedance.

2. Description of Related Art

As a chip inductor which is small in size and has a high impedance, there is conventionally proposed one in which a coiled conducting wire is embedded in a magnetic core.

In the above-described chip inductor, a high impedance can be obtained with a small-sized chip inductor. However, the cross sections on both ends of the coiled conducting wire are brought into point-contact with external electrodes which are formed on axially external surfaces of a magnetic member. Therefore, when a large electric current is caused to flow through the coiled conducting wire, the contact portions give rise to heat generation, resulting in a prematurely breaking of the coiled conducting wire or a poor contact between the coiled conducting wire and the external electrodes.

The present invention has an object of providing a chip inductor which is free from the above-described disadvantages.

SUMMARY OF THE INVENTION

In order to attain the above and other objects, the present invention provides a chip inductor comprising: a magnetic member which is formed by sintering; a coiled conducting wire which is embedded in the magnetic member; the magnetic member having a clearance in each axial end portion thereof such that each terminal end portion of the coiled conducting wire is exposed to an outside of the magnetic member in a linear configuration; and an external electrode which is formed on said each end portion of the magnetic member such that the external electrode penetrates into the clearance into contact with each of the terminal end portions of the coiled conducting wire.

Preferably, the magnetic member comprises an internal magnetic element which serves as a winding core and an external magnetic cover element which is formed to enclose the internal magnetic element. The internal magnetic element is drum shaped with a central recessed portion and flange portions formed on both axial ends of the internal magnetic element. The linear configuration is substantially circular equivalent to about one wind of the coiled conducting wire.

In the above-described arrangement of the chip inductor according to the present invention, the external electrodes and both the terminal end portions of the coiled conducting wire are in contact with each other along a linear configuration. Therefore, when a large electric current is caused to flow through the coiled conducting wire, the electric resistance in the portions of contact between the coiled conducting wire and the external electrodes is relatively smaller than that in the coiled conducting wire. Consequently, there occurs no abnormal heat generation at those portions of contact, resulting in no premature cutting or breaking of the coiled conducting wire and poor contact.

BRIEF DESCRIPTION OF THE DRAWINGS

The above and other objects and the attendant advantages of the present invention will become readily apparent by reference to the following detailed description when considered in conjunction with the accompanied drawings wherein.

DETAILED DESCRIPTION OF PREFERRED EMBODIMENTS

An explanation will now be made about an embodiment of the present invention with reference to the accompanying drawings.

Figure 1:
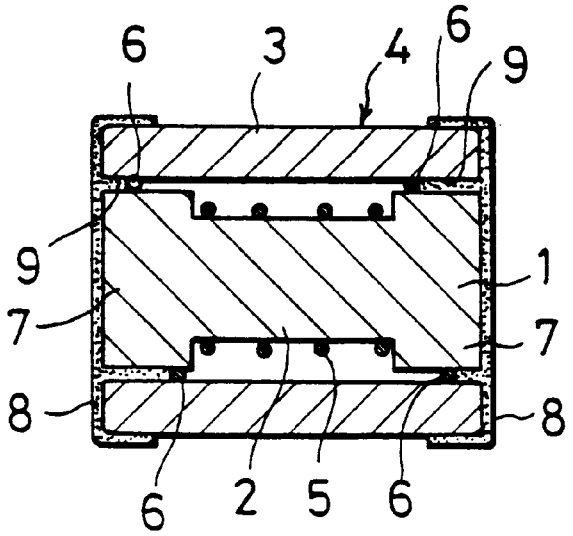
FIG. 1 is a sectional view of a chip inductor according to one embodiment of the present invention.

FIG. 1 represents an example of the chip inductor according to the present invention.

In the Figure, reference numeral 1 denotes a core member in the shape of a drum (hereinafter also referred to as a drum-shaped core member) having a recessed portion 2 in the central part thereof. Reference numeral 3 denotes a cylindrical external cover member. Both the drum-shaped core member 1 and the cylindrical external cover member 3 are formed by obtaining a kneaded material of a powdered magnetic material (or raw meal of a magnetic material) and a binder, charging the kneaded material into a molding apparatus, and then sintering the molded semimanufactured product. A magnetic member 4 of the chip inductor is made up by combining these members.

Around the above-described recessed portion 2 of the drum-shaped core member 1 there is wound a coiled conducting wire 5. Both end portions 6, 6 each having a length corresponding to one wind, for example, of the coiled conducting wire 5 are disposed on each peripheral surface of collars or flanges 7, 7 of the drum-shaped core member 1. The internal diameter of the cylindrical external cover member 3 is formed larger than the outer diameter of the flanges 7, 7 by a dimension equivalent to about two times the diameter of the coiled conducting wire 5. When the cylindrical external cover member 3 is fitted onto the drum-shaped core member 1, the former 3 does not give rise to clattering relative to the latter 1, thereby preventing fluctuations in the characteristics in the chip inductor. Both members 1, 3 are fixed to each other with an adhesive agent, for example. On both end surfaces of the magnetic member 4 which is made up of the drum-shaped core member 1 and the external cover member 3, there are formed external electrodes 8, 8 by coating a silver paste which is made up of a silver powder and a solvent and then baking it onto each of the surfaces. In the connecting portions between the drum-shaped core member 1 and the external cover member 3 on both end surfaces of the magnetic member 4, there are formed, as explained hereinabove, clearances 9, 9 of a width each of which is substantially equal to the diameter of the coiled conducting wire 5. Therefore, when the silver paste is coated on both end surfaces of the magnetic member 4, the silver paste is caused to enter, or penetrate into, the clearances 9, 9 and is brought into contact with both end portions 6, 6 of the coiled conducting wire 5. Each of the end portions has a length of, e.g., about one wind of the coiled conducting wire 5. It follows that, when the external electrodes 8, 8 are formed by baking the silver paste, the external electrodes 8, 8 are in contact with both end portions 6, 6 of the coiled conducting wire 5, each of the end portions having a length of about one wind of the coiled conducting wire 5.

Figure 2:
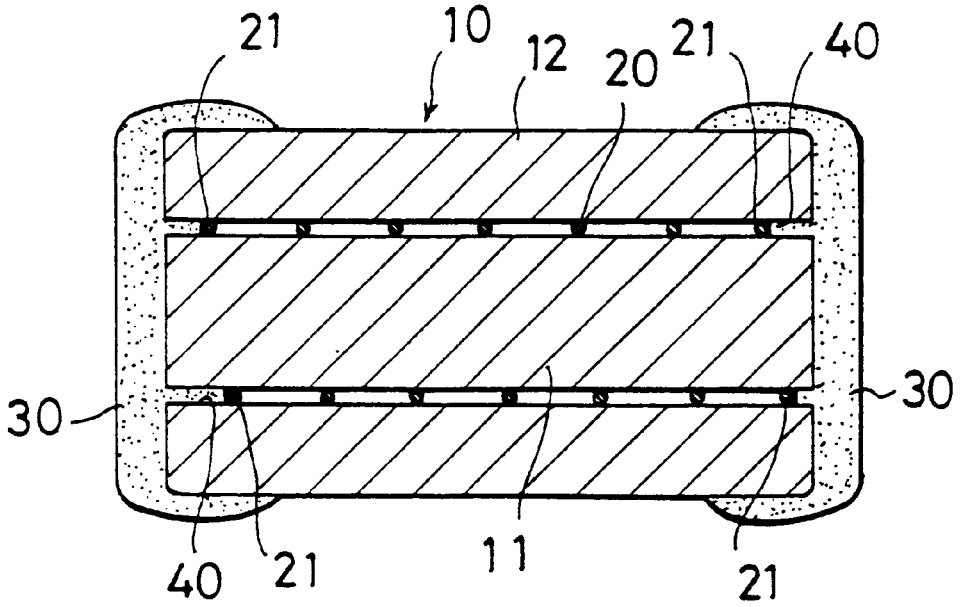
FIG. 2 is a sectional view of a chip inductor according to another embodiment of the present invention.

FIG. 2 represents another embodiment of the chip inductor according to the present invention.

In the Figure, reference numeral 10 denotes a magnetic body of a rectangular parallelepiped which is made of a ferrite, for example. Reference numeral 20 denotes a coiled conducting wire 20 which is embedded in the magnetic body 10. On both end surfaces of the magnetic body 10 and adjoining external peripheral end portions thereof, there are coated or covered external electrodes 30, 30.

The above-described magnetic member 10 is made up of an internal magnetic element which serves as a winding core 11 around which the coiled conducting wire 20 is wound and an external magnetic element which forms an external cover element 12 to cover the coiled conducting wire 20. The winding core 11 is made up of a powdered magnetic material whose composition includes an oxide of, e.g., iron, nickel, zinc or copper and whose particle size is 0.7 $\mu$m, and a binder of glycerine-methyl cellulose. The winding core 11 was manufactured by sintering into a columnar shape a kneaded material of the powder of the magnetic material and the binder mixed in the ratio of 100:8. It had a permeability of 100, and a shrinkage ratio (= a dimension of kneaded material / a dimension of sintered material) at the time of sintering was 1.3, for example. The external cover element 12 was made up of the powder of the magnetic material of the same composition and particle size as those of the above-described winding core, and the same binder. The kneaded material having the powder of the magnetic material and the binder in the same mixing ratio was sintered, and the permeability and the shrinkage percentage thereof at the time of sintering were the same as those of the winding core 11. Reference numeral 40 denotes a clearance formed between the winding core 11 and the external cover element 12. Through these clearances 40, 40 both end portions 21, 21 of the coiled conducting wire 20 of the length equivalent to about one wind are exposed to the external surfaces of the magnetic body 10. Both end portions 21, 21 are thus brought into contact with the external electrodes 30 which are formed in the same manner as in the above-described embodiment.

The chip inductor of the present embodiment was manufactured in the following manner.

Figure 3:
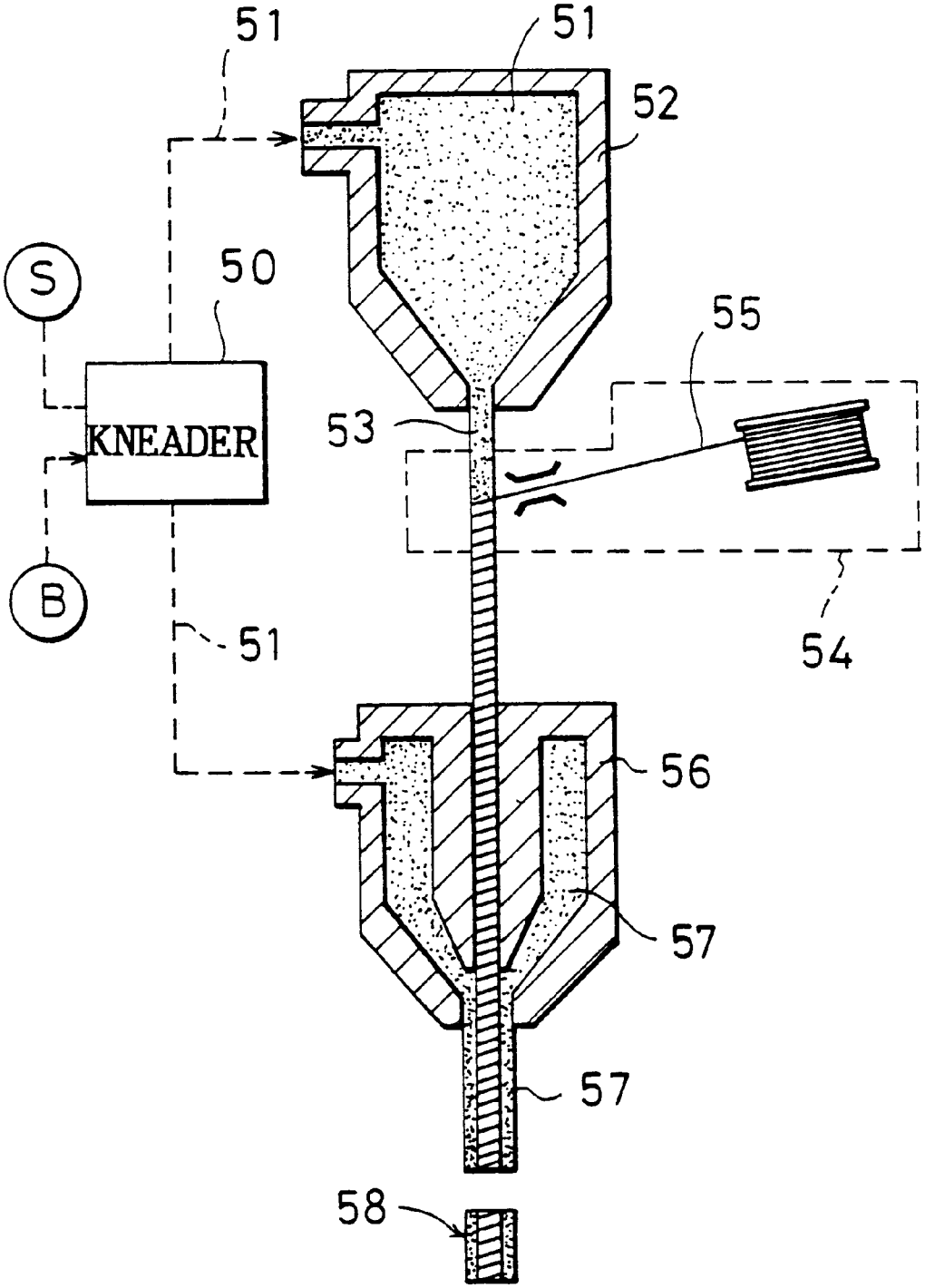
FIG. 3 is a diagram showing the method of manufacturing the chip inductor shown in FIG. 2.

As shown in FIG. 3, a binder S of the above-described mixing ratio and a powder B of a magnetic raw material were kneaded by a kneader 50 to homogenize the powder of the magnetic raw material and the binder. The kneaded material 51 was fed under pressure to a primary extruder 52. A molded bar-like body 53, as a winding core, which was molded to a desired diameter of 0.5–10 mm, for example, was extruded out of an outlet of the primary extruder 52 at a speed of 30 m/min, for example. This bar-like body 53 was dried in a dryer (not illustrated). Thereafter, a conducting wire 55 was wound by a winding device 54 around the bar-like body 53. The bar-like body 53 having wound therearound the conducting wire 55 was fed to a secondary extruder 56. To this secondary extruder 56 there was fed in advance under pressure the kneaded material 51 which is the same as the above-described kneaded material. By this secondary extruder 56 the bar-like body 53 and the conducting wire 10 wound therearound were coated by the kneaded material 51, thereby forming an external cover member (or an external coating element) 57. Thereafter, the semimanufactured product was cut into a size to suit the size of a sintering furnace or the shape of a setting device on which the semimanufactured product is placed for sintering in the sintering furnace. The semimanufactured product was then sintered between 600–1000° C., for example at 900° C., and was cut by a cutting device to suit the dimensions of respective inductors. The individual cut inductor main bodies (or raw materials) 58 were then subjected to barrel polishing using a barreling powder and water and were rounded at the corner portions. When the kneaded material 51 was coated onto the conducting wire 55 wound around the bar-like body 53, the kneaded material 51 does not adhere to the bar-like body 53. Further, the bar-like body 53 and the external cover element 57 have the same shrinkage percentages and consequently the conducting wire 55 is deformed by the shrinkage of the external cover element 57. Therefore, as shown in FIG. 2, each of the individual cut inductor raw materials 58 had formed therein a clearance 40 on each end surface. In this clearance 40 an end portion 21 equivalent in length to about one wind of the coiled conducting wire 20 was exposed. Consequently, when the silver paste consisting essentially of a silver paste and a solvent was coated onto both end surfaces of the individual cut inductor raw material 58 and adjoining external peripheral end portions to impregnate the silver paste into each of the clearances 40 and then baked it to form each of the external electrodes 30, the external electrodes 30 formed by baking were brought into contact with both the end portions 21 of the coiled conducting wire 20 having the length equivalent to about one wind thereof.

According to the above-described arrangement of the present invention, even when a large electric current or a pulse current of large amplitudes were to be passed through the coiled conducting wire, the portions of contact between the coiled conducting wire and the external electrodes do not give rise to abnormal heat generation. As a result, there is no possibility that the wire is prematurely cut or causes poor contact at the portions of contact.

It is readily apparent that the above-described chip inductor meets all of the objects mentioned above and also has the advantage of wide commercial utility. It should be understood that the specific form of the invention hereinabove described is intended to be representative only, as certain modifications within the scope of these teachings will be apparent to those skilled in the art.

Accordingly, reference should be made to the following claims in determining the full scope of the invention.

What is claimed is:

1. A method of manufacturing a chip inductor comprising:

(a) forming a winding core;

(b) winding a conducting wire around said winding core;

(c) coating both said winding core and said conducting wire with an external cover member.

2. A method of manufacturing a chip inductor according to claim 1, further comprising the step of cutting the sintered product obtained by step (d) into pieces, each piece having a predetermined length suitable for a chip inductor.

3. A method of manufacturing a chip inductor according to claim 1, wherein the external cover member is formed by extruding a kneaded material onto both the winding core and the conducting wire.

4. A method of manufacturing a chip inductor according to claim 3, wherein the winding core is formed by extruding, and the conducting wire is wound around the extruded winding core.

5. A method of manufacturing a chip inductor according to claim 4, further comprising the step of sintering the combination of the extruded external cover member and the extruded winding core to form a sintered product.

6. A method of manufacturing a chip inductor according to claim 1, further comprising the step of baking the electrically conductive paste.

7. A method of manufacturing a chip inductor according to claim 1, wherein the electrically conductive paste comprises silver powder and solvent.

8. A method of manufacturing a chip inductor comprising:

(a) forming a winding core;

(b) winding a conducting wire around said winding core;

(c) forming an external cover member on both said winding core and said conducting wire such that a clearance is formed between said winding core and said external cover member;

(d) coating an electrically conductive paste on said combined winding core and external cover member so that said paste enters the clearance and is brought into contact with end portions of the conducting wire.

9. A method of manufacturing a chip inductor according to claim 8, wherein the external cover member is sintered, and is formed by placing the sintered external cover member on both said winding core and said conducting wire in step (c).

10. A method of manufacturing a chip inductor according to claim 8, wherein the external cover member is formed by extruding a kneaded material onto both the winding core and the conducting wire.

11. A method of manufacturing a chip inductor according to claim 10, wherein the winding core is formed by extruding, and the conducting wire is wound around the extruded winding core.

12. A method of manufacturing a chip inductor according to claim 11, further comprising the step of sintering the combination of the extruded external cover member and the extruded winding core to form a sintered product.

13. A method of manufacturing a chip inductor according to claim 12, further comprising the step of cutting the sintered product into pieces, each piece having a length suitable for a chip inductor.

14. A method of manufacturing a chip inductor according to claim 8, further comprising the step of baking the electrically conductive paste.

15. A method of manufacturing a chip inductor according to claim 8, wherein the electrically conductive paste comprises silver powder and solvent.

* * * * *

UNITED STATES PATENT AND TRADEMARK OFFICE

CERTIFICATE OF CORRECTION

PATENT NO. : 6,055,721
DATED : May 2, 2000
INVENTOR(S) : MAMADA et al.

It is certified that error appears in the above-indentified patent and that said Letters Patent is hereby corrected as shown below:

In the claims portion of the patent in claim 1 on line 53, after "external cover member", insert;

--(d) sintering the combination of said winding core with said conducting wire and said external cover member formed in step (c) to form a sintered product such that a clearance is formed between said winding core and said external cover member;

(e) coating an electrically conductive paste on each end of said sintered product so that said paste enters the clearance and is brought into contact with end portions of said conducting wire--.

Signed and Sealed this

Twenty-seventh Day of March, 2001

*Attest:*

Nicholas P. Godici

NICHOLAS P. GODICI

*Attesting Officer*

*Acting Director of the United States Patent and Trademark Office*